US006570313B2

(12) United States Patent
Suzuki et al.

(10) Patent No.: US 6,570,313 B2
(45) Date of Patent: May 27, 2003

(54) COLOR CATHODE-RAY TUBE WITH SHADOW MASK AND FRAME

(75) Inventors: Hideo Suzuki, Hirakata (JP); Michiaki Watanabe, Ibaraki (JP); Yoshikazu Demi, Shiga (JP); Mitsunori Yokomakura, Takatsuki (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 0 days.

(21) Appl. No.: 10/147,008

(22) Filed: May 15, 2002

(65) Prior Publication Data

US 2002/0130606 A1 Sep. 19, 2002

Related U.S. Application Data

(62) Division of application No. 09/384,358, filed on Aug. 27, 1999, now Pat. No. 6,469,431.

(30) Foreign Application Priority Data

Sep. 1, 1998 (JP) ..... 10-246913

(51) Int. Cl.[7] ..... H01J 29/07
(52) U.S. Cl. ..... 313/407
(58) Field of Search ..... 313/402, 407, 313/403, 408

(56) References Cited

U.S. PATENT DOCUMENTS

| | | | | |
|---|---|---|---|---|
| 4,645,968 A | | 2/1987 | Ragland, Jr. | 313/407 |
| 4,827,179 A | | 5/1989 | Adler et al. | 313/402 |
| 5,289,080 A | | 2/1994 | Park | 313/402 |
| 5,525,859 A | * | 6/1996 | Ito et al. | 313/402 |
| 5,610,473 A | * | 3/1997 | Yokota et al. | 313/402 |
| 6,469,429 B1 | * | 10/2002 | Berton | 313/402 |

FOREIGN PATENT DOCUMENTS

| | | | |
|---|---|---|---|
| EP | 0 273 493 | 11/1987 | H01J/29/07 |
| GB | 2 258 941 | 2/1993 | H01J/29/07 |
| JP | 3-500591 | 7/1991 | H01J/29/07 |
| JP | 8-007777 | 1/1996 | H01J/29/07 |
| JP | 8-077936 | 3/1996 | H01J/29/07 |
| WO | 88 10006 | 12/1988 | H01J/29/07 |

OTHER PUBLICATIONS

Adler, et al: "An Unusual Problem in Vibration Damping: The Flat Tension Mask Computer Tube;" Proceedings of the Ultrasonics Symposium; US, New York; IEEE; vol. 2; Oct. 3–6, 1989; pp. 1093–1097.

* cited by examiner

*Primary Examiner*—Michael Day
(74) *Attorney, Agent, or Firm*—Merchant & Gould, P.C.

(57) ABSTRACT

The present invention provides a color cathode-ray tube that can attenuate vibration of an entire shadow mask positively with a simple structure. The color cathode-ray tube comprises a frame-shaped mask frame and a shadow mask in which many apertures are formed in a flat plate, the shadow mask being stretched and fixed in the mask frame in a condition in which a tension force is applied in one direction. The amplitude in the end portions of the shadow mask is not less than a certain amount relative to the amplitude in the center portion of the shadow mask, in a resonance of the shadow mask caused by a vibration propagated to the color cathode-ray tube. Furthermore, by providing vibration attenuators at the end portions of the shadow mask, vibrations at the end portions of the shadow mask are attenuated as the side surfaces of the shadow mask slide on the vibration attenuators. Thus, vibration of the entire shadow mask can be extinguished positively.

5 Claims, 16 Drawing Sheets

(a)

(b)

(a)

(b)

(a)

(b)

(a)

(b)

(a)

(b)

COLOR CATHODE-RAY TUBE WITH SHADOW MASK AND FRAME

This application is a divisional of application Ser. No. 09/384,358, filed Aug. 27, 1999 is now U.S. Pat. No. 6,469,431, which application(s) are incorporated herein by reference.

FIELD OF THE INVENTION

The present invention relates to a color cathode-ray tube used in televisions, computer displays, and the like, particularly to a color cathode-ray tube of the shadow mask type.

BACKGROUND OF THE INVENTION

FIG. 15 shows a cross section of an example of a conventional color cathode-ray tube. The color cathode-ray tube 1 shown in this figure includes a substantially rectangular face panel 2 having a phosphor screen 2*a* formed on its inner surface, a funnel 3 connected to the back side of the face panel 2, an electron gun 4 housed in a neck portion 3*a* of the funnel 3, a shadow mask 6 positioned opposite to the phosphor screen 2*a* inside the face panel 2, and a mask frame 7 for fixing the shadow mask. Furthermore, deflection yokes 5 for deflecting and scanning with electron beams are provided on the outer peripheral surface of the funnel 3. The shadow mask 6 plays a role of color selection for three electron beams that are emitted from the electron gun 4. The letter A indicates a path of an electron beam.

In recent color cathode-ray tubes, in order to reduce reflection of external light and make a good appearance, the surface of the face panel has been made flat as shown in FIG. 15. As the face panel has a flatter surface, the shadow mask also has a flatter surface. As the surface of the shadow mask becomes flatter, the flatness of the shadow mask cannot be maintained only by supporting the body of the shadow mask with a frame.

Furthermore, when being supported only with a frame, the shadow mask is vibrated easily by a vibration from the outside, and the display image of the color cathode-ray tube is adversely affected. Therefore, as shown in FIGS. 16(*a*)–(*b*), a certain amount of tension is applied to the shadow mask (in the direction of the arrows) to stretch and fix the shadow mask in the flame.

On the other hand, during a doming phenomenon in which the surface of a shadow mask is deformed due to thermal expansion caused by electron beams crashing into the shadow mask, as the surface of the shadow mask becomes flat, displacement of an electron beam due to the doming increases, particularly in the vicinities of both ends of the image plane. Thus, in the stretching and fixing of a shadow mask as mentioned above, a practical maximum level of tension close to an elastic limit is applied to the shadow mask to absorb the thermal expansion caused by the crashing electron beams.

By such stretching and fixing, even when the temperature of the shadow mask increases, a discrepancy in the corresponding positions of the aperture for passing an electron beam in the shadow mask and of the phosphor dot on the phosphor screen can be prevented.

A shadow mask that is stretched and fixed is called a tension-type shadow mask. The tension-type shadow mask includes an aperture grill type in which many thin elements are stretched, a slot type in which many approximately rectangular apertures for passing electron beams are formed in a flat plate, and a dot type in which many circular apertures for passing electron beams are formed in a flat plate.

Furthermore, for stretching and fixing a shadow mask, there are one-dimensional and two-dimensional tension methods. The one-dimensional tension method is a method in which a tension is applied only in the longitudinal direction (up-and-down direction) of the shadow mask as shown in FIG. 16(*b*), and the two-dimensional method is a method in which a tension is applied in both the longitudinal and transverse directions as shown in FIG. 16(*a*). In the aperture grill type, the one-dimensional method is employed, and in the slot or dot type, the one-dimensional or two-dimensional method is employed.

As mentioned above, irregular color due to doming phenomenon can be prevented in the tension-type shadow mask. However, vibration of the shadow mask due to a vibration propagated from outside such as from a speaker cannot be restrained completely only by a tension applied to the shadow mask.

Therefore, in order to decrease the vibration of a shadow mask, a damper wire may be extended on the surface of the shadow mask, or may be welded onto the surface of the shadow mask. However, when using such a damper wire, its shadow is reflected in the display image of the color cathode-ray tube, so that the image quality is decreased. Various measures have been proposed up to the present to absorb vibration without causing such problems.

For example, Publication of Unexamined Japanese Patent Application (Tokuhyo) No. HEI 3-500591 has proposed a vibration attenuator comprising a rigid body fixed at a peripheral part of a shadow mask and a resistive body that is connected to the rigid body and is separate from the shadow mask. By providing such a vibration attenuator, vibration energy is extracted from the shadow mask by the rigid body integral with the shadow mask, and the extracted vibration energy is transmitted to the resistive body to be extinguished.

However, a conventional color cathode-ray tube having the above-mentioned vibration attenuator has problems as follows:

(1) In the above-mentioned vibration attenuator, the rigid body is integrated with the shadow mask by welding or the like. Thus, the rigid body itself does not serve to extinguish vibration energy, but it is merely a means for extracting vibration energy. The extracted vibration energy can be extinguished only when it is transmitted to the resistive body that is provided separately. Such a vibration attenuator has a complicated configuration, which leads to problems in cost performance and productivity.

(2) Furthermore, although the vibration attenuator is attached to a peripheral portion of the shadow mask where no aperture is formed, the shadow mask does not always vibrate at the peripheral portion depending on the frequency of the vibration propagated from outside. For example, in the case of a distribution of vibration in which the amplitude is the largest in the center portion of the shadow mask but there is almost no vibration in the right and left peripheral portions, even when a vibration attenuator is provided at a peripheral portion of the shadow mask, it cannot extract and absorb vibration energy from the shadow mask, and its effect of attenuating vibration of the shadow mask cannot be obtained sufficiently.

SUMMARY OF THE INVENTION

The present invention aims to solve the above-mentioned conventional problems, and has an object to provide a color cathode-ray tube in which vibration of an entire shadow mask can be attenuated positively with a simple structure.

In order to achieve the above object, the present invention provides a first color cathode-ray tube comprising a frame-shaped mask frame and a shadow mask in which many slot or dot apertures are formed in a flat plate, the shadow mask being stretched and fixed in the mask frame in a condition in which a tension stress is applied in one direction, wherein the amplitude in the end portions of the shadow mask is not less than a certain amount relative to the amplitude in the center portion of the shadow mask, in a vibration mode of the seventh or less order for a resonance of the shadow mask caused by a vibration propagated to the color cathode-ray tube. According to such a color cathode-ray tube, the maximum value of displacement of the shadow mask due to its vibration can be decreased.

In the first color cathode-ray tube, it is preferable that the amplitude in the end portions of the shadow mask is not less than 20% with respect to the amplitude in the center portion of the shadow mask.

Furthermore, it is preferable that the tension stress in the center portion of the shadow mask is larger than the tension stress in the end portions of the shadow mask. By having such a distribution of tension, the maximum value of displacement of the shadow mask due to its vibration can be decreased, in a resonance of a lower order mode at which the amplitude becomes large.

In a preferable color cathode-ray tube in which the tension stress in the center portion of the shadow mask is larger than the tension stress in the end portions of the shadow mask, when the tension stress in the center portion of the shadow mask is a $\sigma 1$ and the tension stress in the end portions of the shadow mask is a $\sigma 2$, it is preferable to satisfy the following relationship $$\sigma 1 \geqq 1.1\sigma 2.$$

Furthermore, it is preferable that there is a maximum value of tension stress between the center portion and the end portions of the shadow mask. By having such a distribution of tension, the maximum value of displacement of the shadow mask due to its vibration can be decreased, in a resonance of a lower order mode at which the amplitude becomes large.

In a preferable color cathode-ray tube in which there is a maximum value of tension stress between the center portion and the end portions of the shadow mask, when the tension stress in the center portion of the shadow mask is $\sigma 1$, the tension stress in the end portions of the shadow mask is $\sigma 2$, and the tension stress in the intermediate portions between the center portion and the end portions is $\sigma 3$, it is preferable to satisfy the following relationships $$\sigma 3 \geqq 1.1\sigma 1,$$

$$\sigma 2 \geqq \sigma 1,$$

and $$\sigma 3 \geqq \sigma 2.$$

Next, the present invention provides a second color cathode-ray tube comprising a shadow mask and a mask frame for fixing the shadow mask, the shadow mask being fixed in the mask frame in a condition in which a tension is applied, which is provided with a vibration attenuator that is in contact with an end portion of the shadow mask and formed of an elastic body, and in which vibration of the shadow mask is attenuated as the shadow mask slides on the vibration attenuator. According to such a color cathode-ray tube, when the shadow mask vibrates, it slides on the vibration attenuator, so that the vibration energy is consumed by friction due to the sliding.

In the second color cathode-ray tube, it is preferable that the vibration attenuator is in contact with an end portion of the shadow mask, applying an in-plane force to the shadow mask. According to such a color cathode-ray tube, when the shadow mask vibrates, the vibration attenuator can attenuate the vibration while being in contact with the shadow mask constantly.

Furthermore, it is preferable that a dead weight for adjusting the effect of attenuating vibration of the shadow mask is attached to the vibration attenuator. According to such a color cathode-ray tube, the in-plane force that is applied to the shadow mask can be adjusted relatively easily by the dead weight.

Furthermore, it is preferable that the in-plane force is in the range of 0.3 to 3.0 gf. This range is preferable because of the following reasons: If the in-plane force is less than 0.3 gf, a frictional force necessary for the attenuation is not ensured. On the other hand, if the in-plane force is more than 3.0 gf, the frictional force becomes too strong, so that the end portions of the shadow mask may be fixed. In this case, the end portions become nodes of vibration, and the vibration is transferred to the center portion of the shadow mask, thus making the vibration even larger.

Furthermore, it is preferable that the vibration attenuator is in contact with a side surface of the shadow mask.

Furthermore, it is preferable that the vibration attenuator is inserted through a hole formed in an end portion of the shadow mask.

Furthermore, it is preferable that the shadow mask is a flat plate in which many slot or dot apertures are formed, and in which a tension is applied in one direction.

Furthermore, it is preferable that the amplitude in the end portions of the shadow mask is not less than a certain amount relative to the amplitude in the center portion of the shadow mask, in a vibration mode of the seventh or less order for a resonance of the shadow mask caused by a vibration propagated to the color cathode-ray tube. According to such a color cathode-ray tube, by positioning the vibration attenuator in an end portion, the vibration of the entire shadow mask can be attenuated effectively.

Next, the present invention provides a third color cathode-ray tube comprising a shadow mask and a mask frame for fixing the shadow mask, the shadow mask being fixed in the mask frame in a condition in which a tension is applied, which is provided with a vibration attenuator attached to the shadow mask, and in which the vibration attenuator does not have any portion adhering to the shadow mask and also is movable.

According to such a cathode-ray tube, when the shadow mask vibrates, the vibration attenuator does not vibrate integrally with the shadow mask, but vibrates separately and independently from the shadow mask, while repeating contacting and sliding with the shadow mask or temporarily being separated therefrom. Thus, vibration energy of the shadow mask is consumed by the friction caused by such contacting and sliding between the shadow mask and the vibration attenuator, so that the vibration of the shadow mask can be attenuated.

In the third color cathode-ray tube, it is preferable that the vibration attenuator is inserted through a hole formed in the shadow mask. According to such a color cathode-ray tube, the vibration attenuator can be attached to the shadow mask in such a way it is movable with a simple structure.

Furthermore, it is preferable that the vibration attenuator is a ring-shaped member.

Furthermore, it is preferable that the vibration attenuator is a frame-shaped member.

Furthermore, it is preferable that the mass of the vibration attenuator is in the range of 0.02 to 5.0 g. This range is preferable because of the following reasons: If the mass is less than 0.02 g, a frictional force necessary for the attenuation is not ensured. On the other hand, if the mass is more than 5.0 g, vibration at the attached portion may be restrained from the beginning, and in this case the vibration is transferred to other portions.

Furthermore, it is preferable that the vibration attenuator is attached to a portion of the shadow mask where no apertures for passing electron beams are formed.

Furthermore, it is preferable that the vibration attenuator is attached to a portion of the shadow mask where apertures for passing electron beams are formed.

Furthermore, it is preferable that a second vibration attenuator other than the above-mentioned vibration attenuator (first vibration attenuator) is provided for attenuating the vibration of the first vibration attenuator by contacting with it when it is vibrating. According to such a color cathode-ray tube, the effect of attenuating vibration can be more enhanced.

Furthermore, it is preferable that the shadow mask is a flat plate in which many slot or dot apertures are formed and a tension is applied in one or two directions.

Furthermore, it is preferable that the amplitude in the end portions of the shadow mask is not less than a certain amount relative to the amplitude in the center portion of the shadow mask, in a vibration mode of the seventh or less order for a resonance of the shadow mask caused by a vibration propagated to the color cathode-ray tube. According to such a color cathode-ray tube, by positioning the vibration attenuator in an end portion, vibration of the entire shadow mask can be attenuated effectively.

DESCRIPTION OF THE PREFERRED EMBODIMENTS

Figure 15:
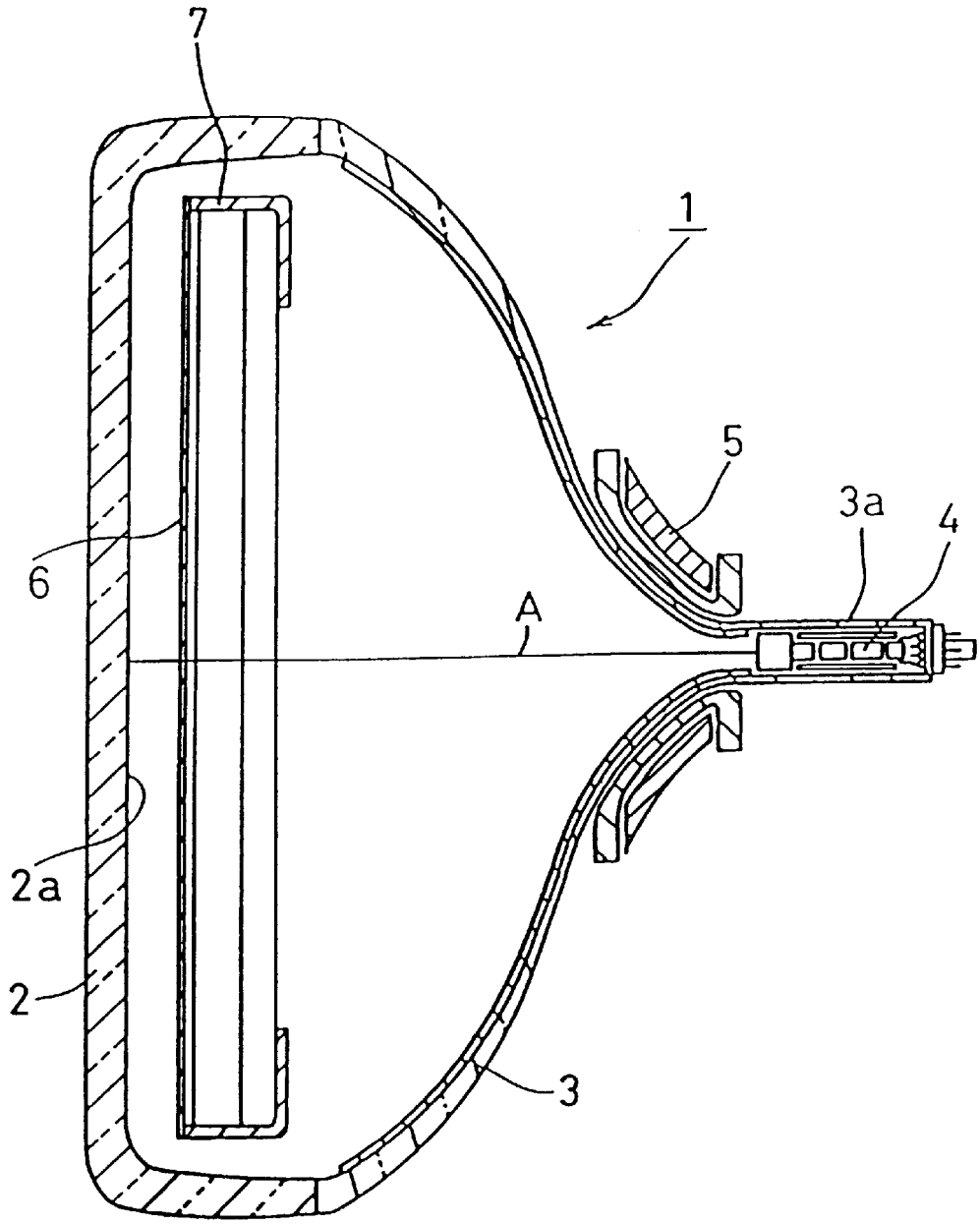
FIG. 15 PRIOR ART
FIG. 15 is a cross-sectional view of an example of a conventional color cathode-ray tube.
Figure 16:
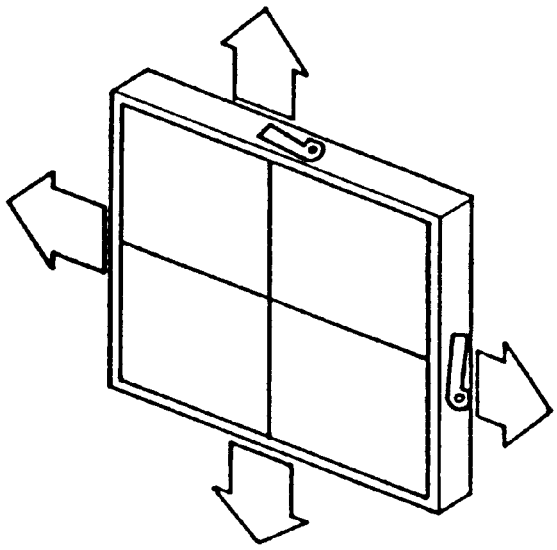
FIG. 16 PRIOR ART
FIG. 16 shows sections of tension in conventional color cathode-ray tubes.
Figure 16:
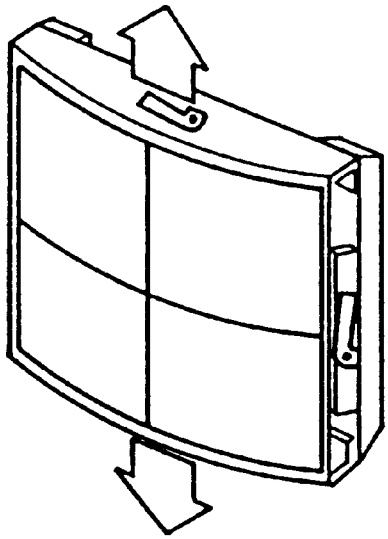
FIG. 16 PRIOR ART

In the following, embodiments of the present invention will be described in detail with reference to the drawings. The shadow mask of a color cathode-ray tube as described below is a flat plate mask, and the same configuration of the color cathode-ray tube described above with reference to FIG. 15 is used in the following embodiments.

First Embodiment

Figure 1:
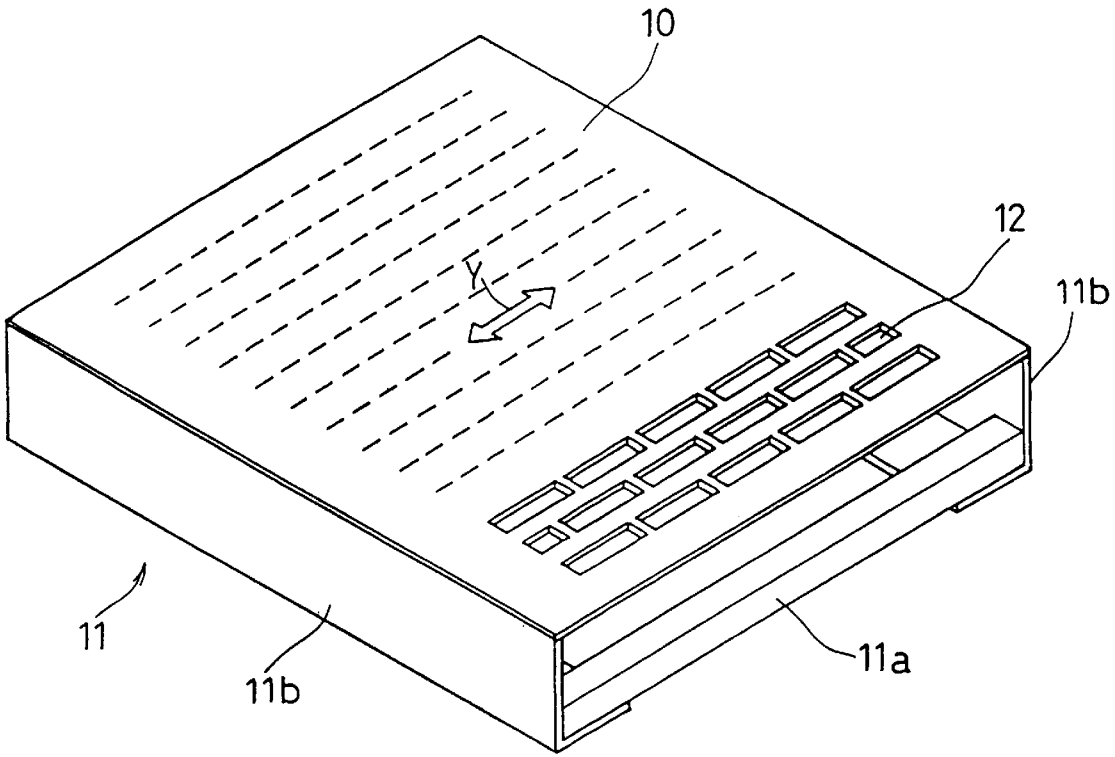
FIG. 1 is a perspective view showing an embodiment of an assembly of a shadow mask and a mask frame according to the present invention.

FIG. 1 shows a perspective view of an assembly of a shadow mask and a mask frame according to the first embodiment. This figure shows a condition in which a shadow mask 10 is stretched and fixed in a mask frame 11.

The mask frame 11 of this embodiment has a rectangular shape and is formed of two frames 11*a* for right and left and two frames 11*b* for top and bottom. In this embodiment, the one-dimensional tension method is employed, and a tension stress is applied to the shadow mask 10 in the up-and-down direction (the direction of an arrow Y).

Furthermore, the shadow mask shown in this figure is a flat plate of slot type. Although only a part of them is illustrated in this figure, many approximately rectangular apertures 12 for passing electron beams that are regularly arranged are formed in the shadow mask 10.

When the tension stress in the center portion of the shadow mask is $\sigma 1$ and the tension stress in the end portions of the shadow mask is $\sigma 2$, an inequality (1) below preferably is satisfied $$\sigma 1 \geqq 1.1\sigma 2. \quad (1)$$

Figure 2:
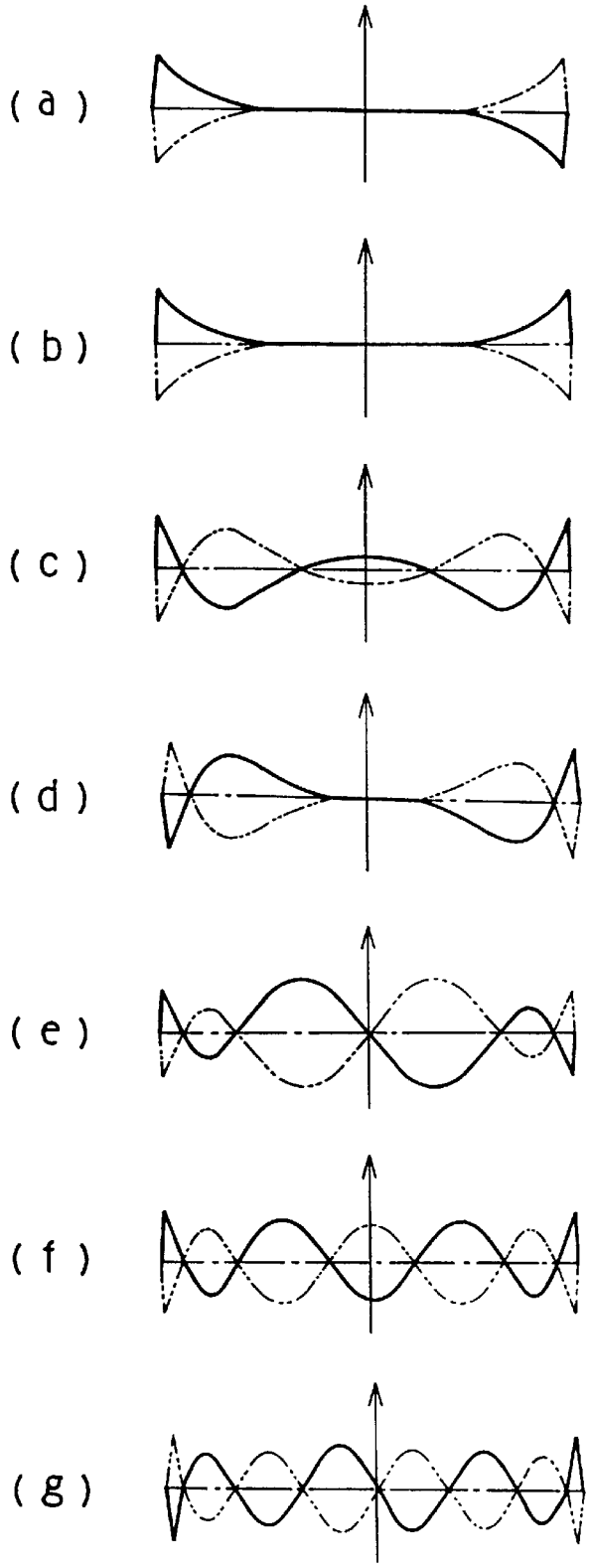
FIG. 2 illustrates an example of a condition of vibration of a shadow mask according to a first embodiment of the color cathode-ray tube of the present invention.

As an example of a shadow mask having such a distribution of tension stress, FIG. 2 shows an analysis of the vibration modes for a shadow mask in which the tension stress $\sigma 1$ at the center portion is 140% of the tension stress $\sigma 2$ at the end portions ($\sigma 1 = 1.4\sigma 2$). The shadow mask used herein was an inver material (36% Ni—Fe alloy) of 29 type (68 cm) with an aspect ratio of 4:3 and with a thickness of 100 $\mu$m, and the amount of the tension applied to the shadow mask was 5 to 50% of the yield stress.

The transverse axis in FIG. 2 indicates a position of the shadow mask in the right-to-left direction (horizontal direction on the image plane), and its right and left ends correspond to the right and left side surfaces of the shadow mask, and the point of intersection between the longitudinal and transverse axes corresponds to the center point of the shadow mask in the right-to-left direction. The longitudinal axis indicates displacement of the shadow mask in the up-and-down direction. The solid line represents displacement in a horizontal line on the shadow mask at which displacement becomes the maximum. Each portion of the shadow mask on this horizontal line vibrates in the up-and-down direction over the range indicated between the solid line and the two-dot chain line (amplitude) during a cycle.

Furthermore, with respect to the value of amplitude, each drawing of FIG. 2 is normalized by determining the maximum value of amplitude as one, so that the node and antinode of vibration of the shadow mask in the right-to-left direction can be seen easily. Therefore, the size of the amplitude cannot be compared generally with each drawing of vibration mode. The above explanation for FIGS. 2 also is applied to FIGS. 6 to 8.

FIGS. 2(*a*) to (*g*) show the first-order mode, the second-order mode, and from there through the seventh-order modes of vibration of the shadow mask in right-to-left direction, respectively. The first-order mode herein refers to the first peak of frequency (resonance point) at which, when vibrations with different frequencies are added at a constant acceleration, a vibration larger than the acceleration (resonance) is generated.

The second peak and thereafter are in order referred to as the second-order mode, the third-order mode, and so forth, respectively. That is, with regard to the vibration of the shadow mask, if the rigidity (Young's modulus and Poisson's ratio, etc.) of the shadow mask, the amount of tension, and the mass of the shadow mask are determined, the vibration mode and the resonance frequency of the shadow mask can be determined by calculations. Thus, such an analysis can be performed.

Figure 3:
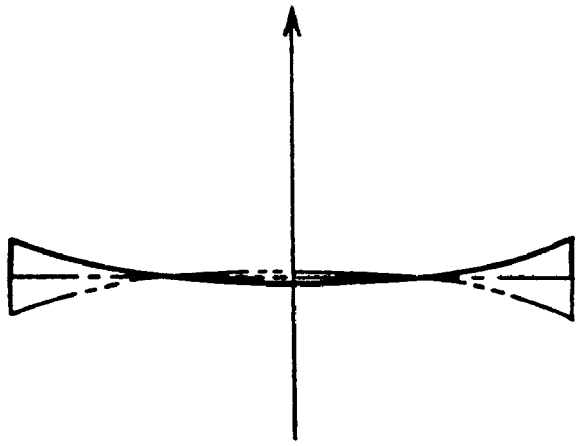
FIG. 3 illustrates a preferable pattern of a resonance of the shadow mask according to the first embodiment of the color cathode-ray tube of the present invention.
Figure 3:
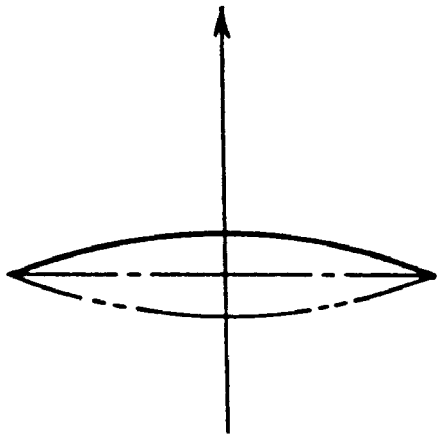
Figure 4:
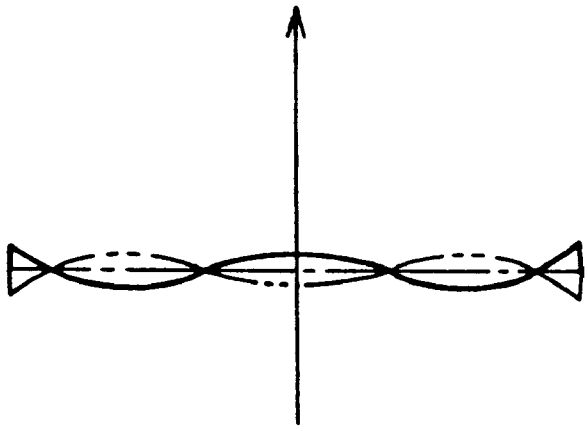
FIG. 4 illustrates another preferable pattern of a resonance of the shadow mask according to the first embodiment of the color cathode-ray tube of the present invention.
Figure 4:
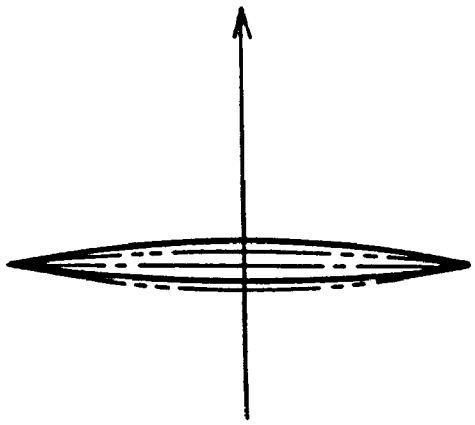
Figure 5:
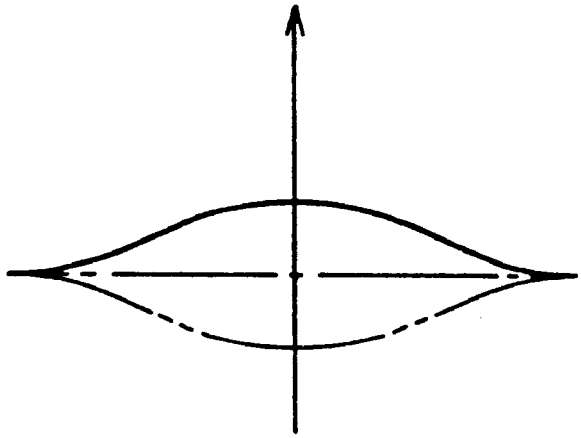
FIG. 5 illustrates a non-preferable pattern of vibration of a shadow mask of a color cathode-ray tube according to a comparative example.
Figure 5:
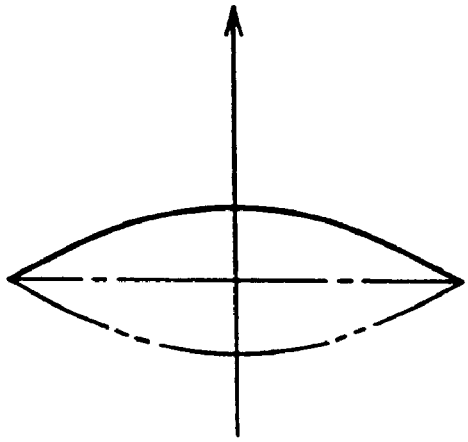

As is understood from FIG. 2, in the case of the shadow mask of this embodiment, in any mode up to the seventh-order mode, the vibration at the end portions is not less than a certain amount with respect to the vibration at the center portion. FIGS. 3 and 4 show examples of such a vibration pattern in which the vibration at the end portions is not less than a certain amount with respect to the vibration at the center portion. FIG. 5 shows an opposite pattern in which the shadow mask vibrates only at the center portion but does not vibrate at the end portions.

In FIGS. 3 to 5, (a) represents displacement in each portion of the shadow mask in the right-to-left direction (horizontal direction on the image plane), and (b) represents displacement in each portion of the shadow mask in the longitudinal direction (vertical direction on the image plane). The relationship between the solid line and the two-dot chain line is the same as in FIG. 2. However, the amplitude in each drawing is not normalized as in FIG. 2, so that the size of the amplitude can be compared with each of the drawings.

Moreover, although the amplitude in the center portion is smaller than the amplitude in the end portions in FIGS. 3 and 4, as a result of investigation by the inventors, it was found that as long as the amplitude in the end portions is not less than 20% of the amplitude in the center portion, a decrease in the image quality due to the amplitude of the shadow mask does not become a practical problem because of the location of the node of vibration.

As is apparent from each drawing, in the vibration patterns of FIGS. 3 and 4, the space between the nodes of vibration of the portion having the largest vibration is smaller than the length of the shadow mask in the right-to-left direction. This is more conspicuous in the pattern of FIG. 4 than in the pattern of FIG. 3. However, when the shadow mask vibrates only at the center portion but does not vibrate at the end portions as in FIG. 5, the space between the nodes of the vibration becomes approximately equal to the length of the shadow mask in the right-to-left direction, so that the amplitude of the vibration becomes the largest.

Therefore, by having a vibration pattern in which the vibration at the end portions of the shadow mask is not less than a certain amount with respect to the vibration at the center portion as shown in FIGS. 3 and 4, the maximum amplitude of the shadow mask can be decreased.

Figure 6:
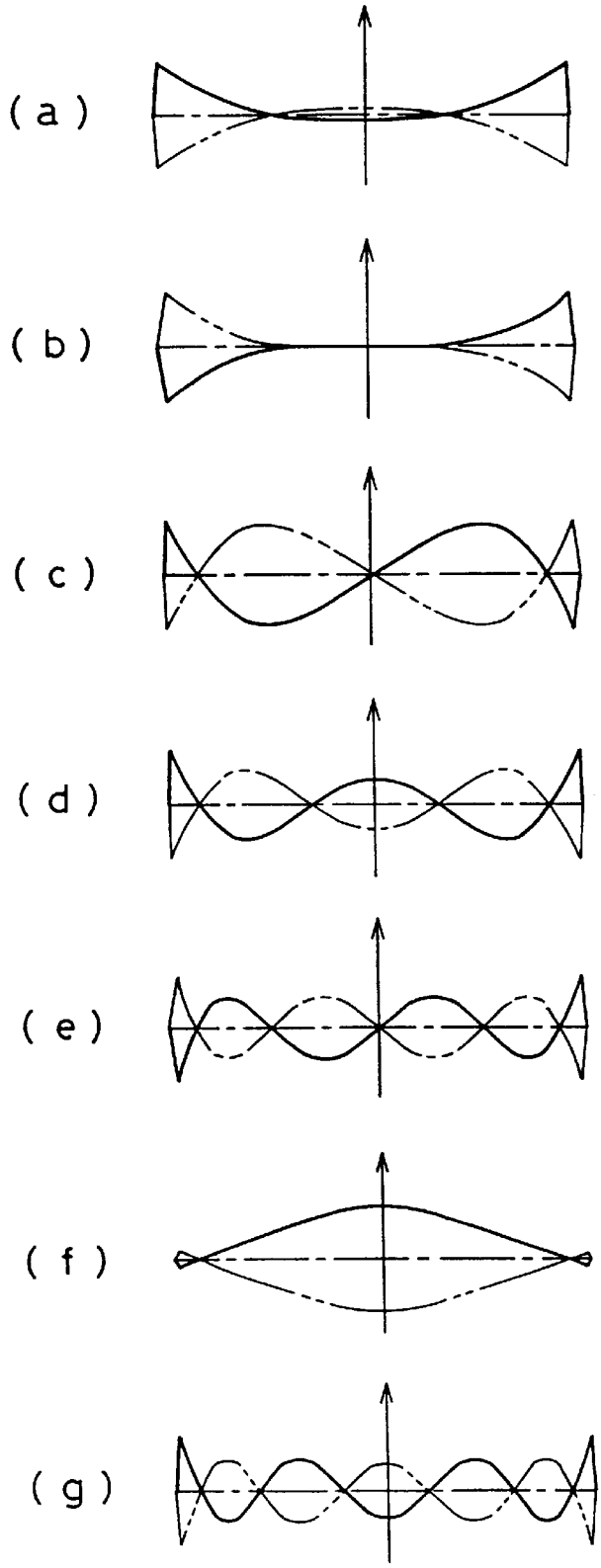
FIG. 6 illustrates an example of the vibration condition of a shadow mask of a color cathode-ray tube according to a comparative example.
Figure 7:
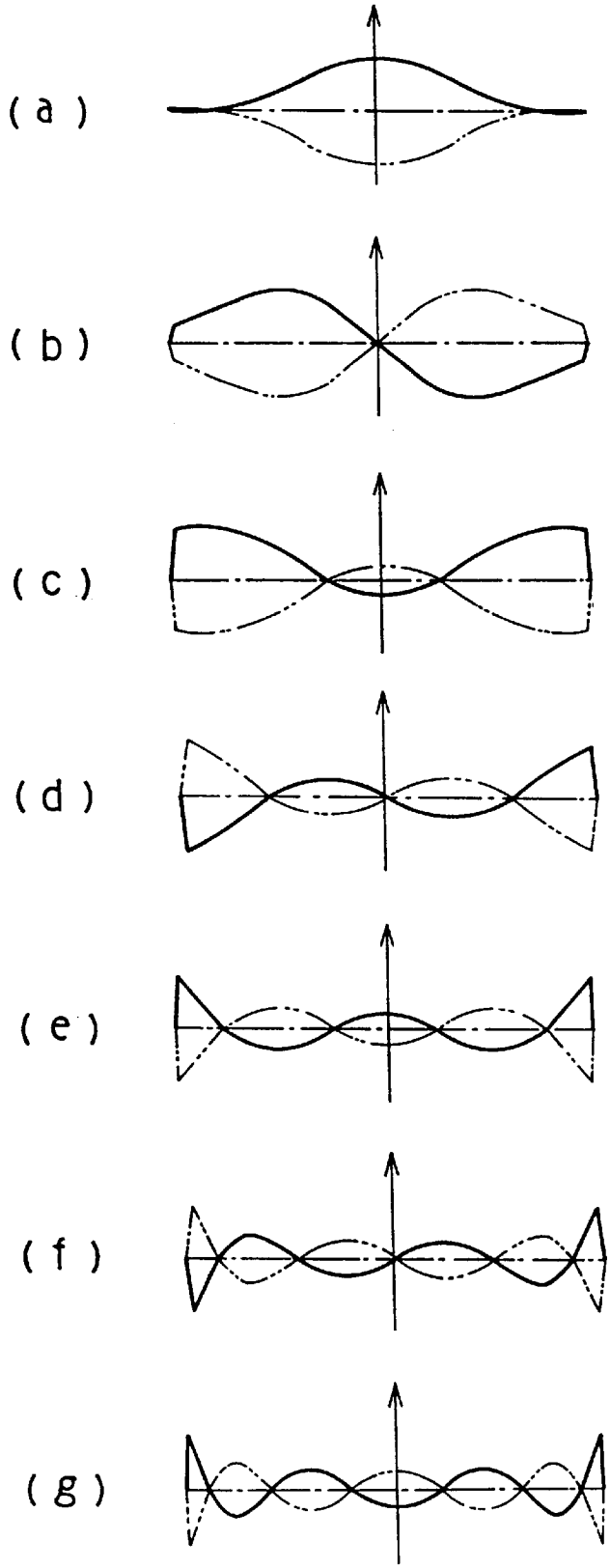
FIG. 7 illustrates an example of the vibration condition of a shadow mask in a color cathode-ray tube according to a comparative example.

As comparative examples to confirm the effect of this embodiment, FIG. 6 shows the result of mode analysis of a case in which the tension stress of the shadow mask is constant in the right-to-left direction, that is, $\sigma 1=\sigma 2$; and FIG. 7 shows the result of mode analysis of a case in which the tension stress in the end portions is twice the tension stress in the center portion, that is, $\sigma 1<\sigma 2$, which is the opposite to this embodiment.

As is evident from FIGS. 6 and 7, in the case of $\sigma 1=\sigma 2$, a pattern as shown in FIG. 5, in which the amplitude of the shadow mask becomes large and the vibration at the end portions of the shadow mask is not more than a certain amount, is developed in the sixth-order mode (FIG. 6(*f*)), and in the case of $\sigma 1<\sigma 2$, the pattern is generated from the first-order mode (FIG. 7(*a*)).

In the pattern of the sixth-order mode in FIG. 6, the amplitude in the end portions is about 13% of the amplitude in the center portion, so that it does not satisfy the above-mentioned condition for vibration having no practical problem in which the amplitude in the end portions is not less than 20% with respect to the amplitude in the center portion. As mentioned below, when a color cathode-ray tube of 33 type (78 cm) was actually produced, its vibration was observed with the naked eye, and thus it was not suitable for practical use. Moreover, in FIG. 7, it was confirmed that the end portions of the shadow mask became the nodes of vibration almost completely in the first-order mode and the shadow mask vibrated largely. Thus, it was not in a level that was suitable for practical use.

The resonance of the shadow mask appears more clearly in a lower-order mode, beginning with the first-order mode in which generation of a resonance is most conspicuous. Therefore, it is understood that the amplitude of the shadow mask is small in this embodiment, in which such a pattern as shown in FIG. 5 is not developed in the seventh or lower order mode, which is easily recognized as a deterioration of the image quality in a practical use, compared with the above-mentioned two examples (FIGS. 6 and 7). That is, it is understood that the amplitude of the shadow mask of this embodiment is also small when compared with the case of uniform distribution of tension, which is considered as a general distribution of tension in a mask having one-dimensional tension.

Moreover, although the case of $\sigma 1=1.4\sigma 2$ has been described in this embodiment, as long as the tension stress in the center portion of the shadow mask is larger than the tension stress in the end portions, the same effect of attenuating vibration as this embodiment can be obtained. However, the effect is more ensured when an inequality of $\sigma 1 \geqq 1.1\sigma 2$ is satisfied. Moreover, the ratio between $\sigma 1$ and $\sigma 2$ may be determined as appropriate at least in the range of $\sigma 1>\sigma 2$ depending on the size and the aspect ratio of the shadow mask, material of the shadow mask, the amount of the tension stress, and the form of the surface of the shadow mask (flat or cylindrical, etc.).

Second Embodiment

The second embodiment also relates to a shadow mask using the one-dimensional tension method as in the first embodiment. As shown in FIG. 1, the tension stress is applied to the shadow mask 10 in the up-and-down direction (direction of the arrow Y). When the tension stress in the center portion of the shadow mask is $\sigma 1$, the tension stress in the end portions of the shadow mask is $\sigma 2$, and the tension stress in the intermediate portions (two portions for the right and left) between the center portion and the end portions of the shadow mask is $\sigma 3$, the inequalities (2) to (4) below preferably are satisfied $$\sigma 3 \geqq 1.1\sigma 1, \quad (2)$$

$$\sigma 2 \geqq \sigma 1, \text{ and} \quad (3)$$

$$\sigma 3 \geqq \sigma 2. \quad (4)$$

Figure 8:
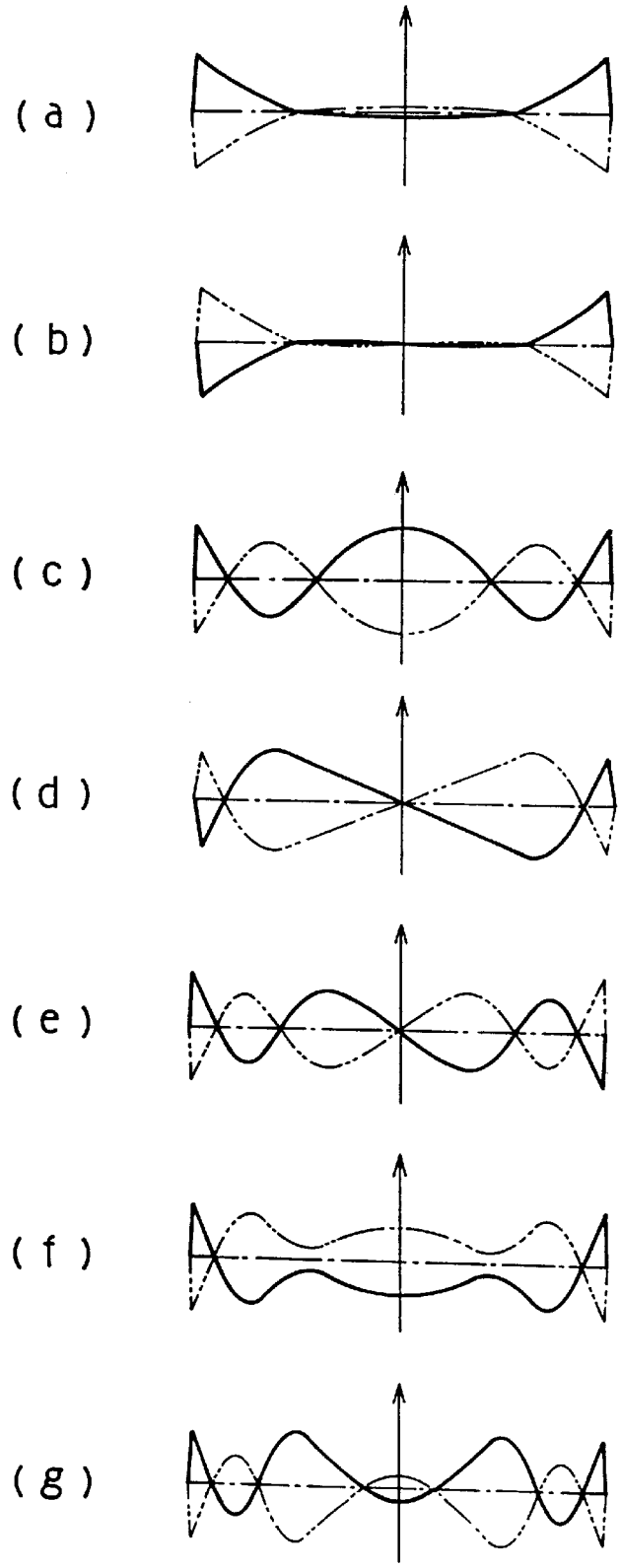
FIG. 8 illustrates an example of the vibration condition of a shadow mask according to a second embodiment of the color cathode-ray tube of the present invention.

FIG. 8 shows an example of this embodiment. This figure shows the vibration modes when the tension stress $\sigma 2$ at the both end portions is 100%, the tension stress $\sigma 1$ at the center portion is 80%, and the tension stress $\sigma 3$ at the intermediate portions between the center portion and the end portions is 140%. The definition of the mode and the method of the illustration are the same as in FIG. 2.

As is evident from FIG. 8, a vibration pattern in which the shadow mask does not vibrate in the end portions also was not developed up to the seventh-order mode in this embodiment. According to an analysis result, even in the tenth-order mode, the pattern in which the shadow mask does not vibrate at the end portions was not developed. Thus, it is understood that vibration of the shadow mask also can be decreased in the case of the distribution of tension stress of this embodiment that satisfies the inequalities (2) to (4).

The inventors actually produced a color cathode-ray tube of 33 type (78 cm) and a color cathode-ray tube of 29 type (68 cm) to be provided for measurements. According to the results of the measurement, the cathode-ray tube of the second embodiment exhibited the smallest vibration, and also the cathode-ray tube of the first embodiment had no problem in practice. However, in the case of a color cathode-ray tube having a relationship of $\sigma 1 = \sigma 2$ or $\sigma 1 < \sigma 2$, vibration of the shadow mask caused by a vibration of a speaker positioned adjacent to the color cathode-ray tube appeared on the image plane, and the image quality became unsuitable for practical use.

Moreover, although the case having a relationship of $\sigma 2 \geqq \sigma 1$ has been described in the above second embodiment, it is not limited to this case. And it was confirmed that even in the case having a relationship of $\sigma 2 < \sigma 1$, when there is a distribution of tension stress having a maximum value in the intermediate portions between the center portion and the end portions of the image plane, the vibration of the shadow mask can be decreased to a level with no practical problem.

Moreover, although only the resonance points at which a vibration larger than the acceleration of adding vibrations have been investigated by mode analysis in the above first and second embodiments, according to an experiment conducted by the inventors, it was confirmed that the display image is adversely affected by a vibration added to the shadow mask from a speaker positioned adjacent to the shadow mask only at the resonance points at which the acceleration of response becomes larger than the acceleration of adding vibration. Therefore, it was confirmed that it is practically sufficient to determine the vibration of the shadow mask in the analysis of modes in which a vibration larger than the acceleration of adding vibrations is generated.

With respect to the frequency of a vibration, a vibration caused by a sound signal generated by a speaker ranges from 20 to 20,000 Hz. However, as the frequency increases, the amplitude of the vibration decreases in inverse proportion to the square of the frequency. Therefore, it is practically enough to analyze only vibrations of low frequencies. Thus, it is considered to be sufficient to investigate the vibration modes of up to the seventh-order.

Moreover, in the analysis of the vibration mode in the first and second embodiments, the number of the order was not determined for an apparently defective mask that generates wrinkles, or a mask having small protrusions at its peripheries, or the like. That is, when the shadow mask has a portion with a considerably weaker tension stress than other portions (in this case, the surface of the shadow mask of that portion becomes wrinkled), or when the shape of the shadow mask is irregular, only that portion with a weaker tension stress or the protrusions is vibrated at low frequencies. However, such specific conditions could not be considered, because the vibration analysis in the above embodiments of the present invention was performed for the entire surface of the shadow mask.

Furthermore, the shadow mask may have a perfectly flat surface or a so-called cylindrical surface that curves only in the direction of the long side. Moreover, the apertures for passing electron beams formed in the mask of a flat plate may be of dot or slot type.

Moreover, distribution of varied tension stress in the shadow mask may be accomplished easily by known means such as by controlling the stretching machine when the shadow mask is stretched in the frame.

Third Embodiment

Figure 9:
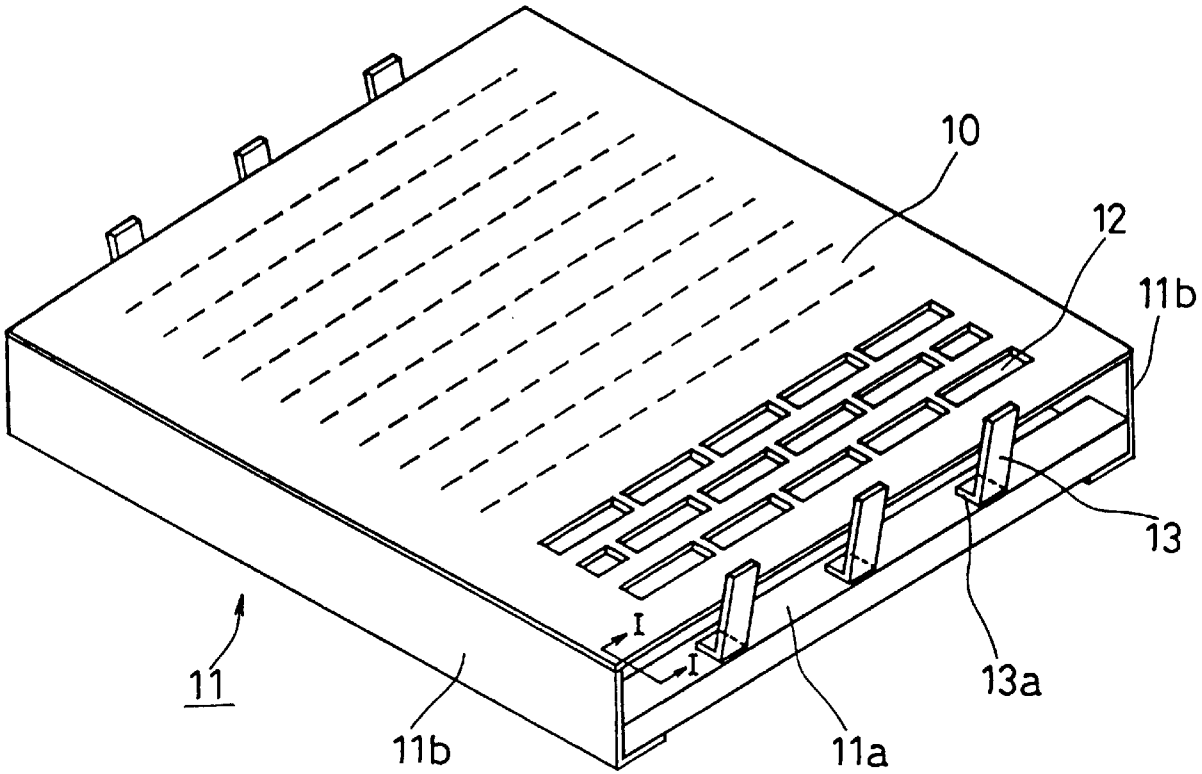
FIG. 9 is a perspective view showing an embodiment of an assembly of a shadow mask and a mask frame according to a third embodiment of the present invention.

FIG. 9 shows a perspective view of the shadow mask part according to the third embodiment. This figure shows a condition in which a shadow mask 10 is stretched and fixed in a mask frame 11. In this embodiment, the one-dimensional tension method is employed, and a tension stress is applied to the shadow mask 10 in the up-and-down direction as in the first and second embodiments. This is also the same in the fourth through sixth embodiments mentioned below.

Figure 10:
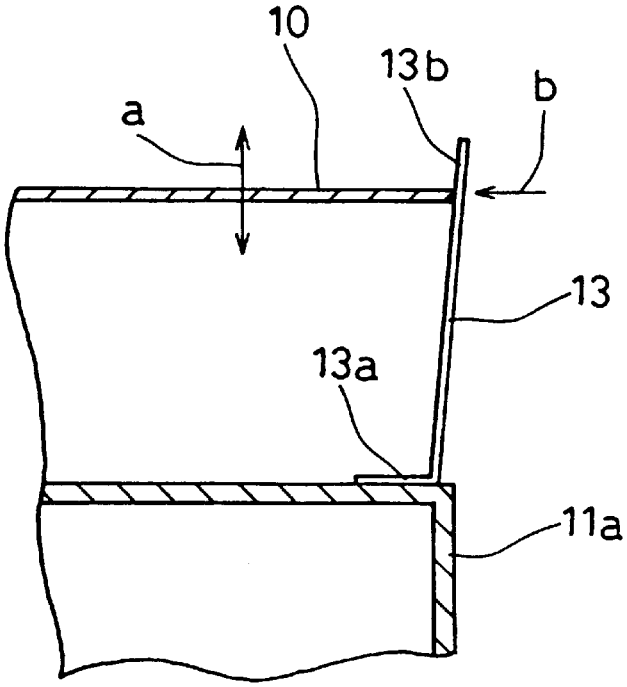
FIG. 10 is a cross-sectional view taken along the line I—I of FIG. 9.
Figure 10:
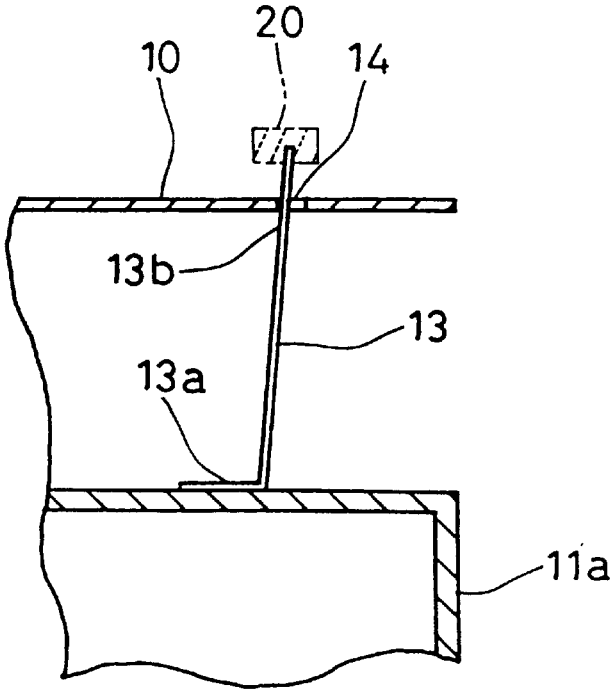

Vibration attenuators 13 formed of elastic bodies are in contact with the side surfaces of the shadow mask 10. End portions 13*a* of the vibration attenuators 13 are fixed to the mask frames 11*a* by welding or the like. FIG. 10(*a*) illustrates a cross-sectional view taken along the line I—I of FIG. 9 to show the relationship between the side surface of the shadow mask 10 and the vibration attenuator 13.

Vibration of the shadow mask 10 is attenuated as the shadow mask 10 slides up and down in the direction of the arrow (a) on a side 13*b* of the vibration attenuator 13. Vibration is attenuated by such a sliding because vibration energy is consumed by friction due to the sliding. Therefore, in this embodiment, vibration energy is absorbed by the vibration attenuator 13 itself. Thus, it is not particularly necessary to connect a second vibration attenuator to the vibration attenuator 13, and vibration of the shadow mask 10 can be attenuated with a simple structure.

It is preferable that a certain amount of force is applied in the direction of the arrow (b) to ensure the sliding of the shadow mask 10 on the vibration attenuator 13. It is also preferable that this force is in the range of 0.3 to 3.0 gf (grams force). This range is preferable because of the following reasons: If the force is less than 0.3 gf, a frictional force necessary for the attenuation is hard to ensure. On the other hand, if the force is more than 3.0 gf, the frictional force becomes too strong, so that the end portions of the shadow mask 10 may be fixed. In this case, the end portions become the nodes of vibration, and the vibration is transferred to the center portion of the shadow mask 10, thus making the vibration even larger.

It is not necessary to provide a special means to apply such a force, and the spring effect of the vibration attenuator 13 may be utilized. For example, while the vibration attenuator 13 has a standing portion formed in the vertical position as an independent product, the end portion 13*a* is fixed to the frame 11*a* in a position such that the standing portion is inclined as illustrated in FIG. 10(*a*) in an assembly.

Moreover, FIG. 10(*a*) shows an embodiment in which the vibration attenuator 13 is in contact with the side surface of the shadow mask 10. However, as shown in FIG. 10(*b*), the vibration attenuator 13 also may be inserted through a hole 14 formed in the end portion of the shadow mask 10. In this case, the same effect also can be obtained because the shadow mask 10 can slide on the side 13*b* of the vibration attenuator 13 in the portion of the hole 14.

Furthermore, as shown with a two-dot chain line in FIG. 10(*b*), a predetermined dead weight 20 may be provided at the free end of the vibration attenuator 13. In this case, the in-plane force applied to the shadow mask 10 through the vibration attenuator 13 can be adjusted relatively easily with the dead weight. The position of the dead weight is not limited to the free end of the vibration attenuator 13, and the dead weight also may be provided at the intermediate portion of the vibration attenuator 13.

Furthermore, although the part of the vibration attenuator 13 in contact with the side surface of the shadow mask 10 is a flat plate in the examples shown in FIGS. 9 and 10, it also may have a rod-shape such as a cylinder or square pole.

Moreover, by combining the vibration attenuator of this embodiment with the shadow mask having the above-mentioned distribution of tension stress of the first and second embodiments, vibration generated at the end portions of the shadow mask can be absorbed. And due to the multiplier effect of them, the amplitude of the shadow mask can be decreased, and also the vibration of the shadow mask can be absorbed within a short time. Thus, adverse effects on the image display exerted by vibration of the shadow mask can be cancelled almost completely.

That is, in this case, vibration generated in the shadow mask is positively concentrated on the end portions to attenuate the vibration by the vibration attenuators. Thus, it is considered that even if vibration is generated in the shadow mask, it can be attenuated rapidly.

Fourth Embodiment

Figure 11:
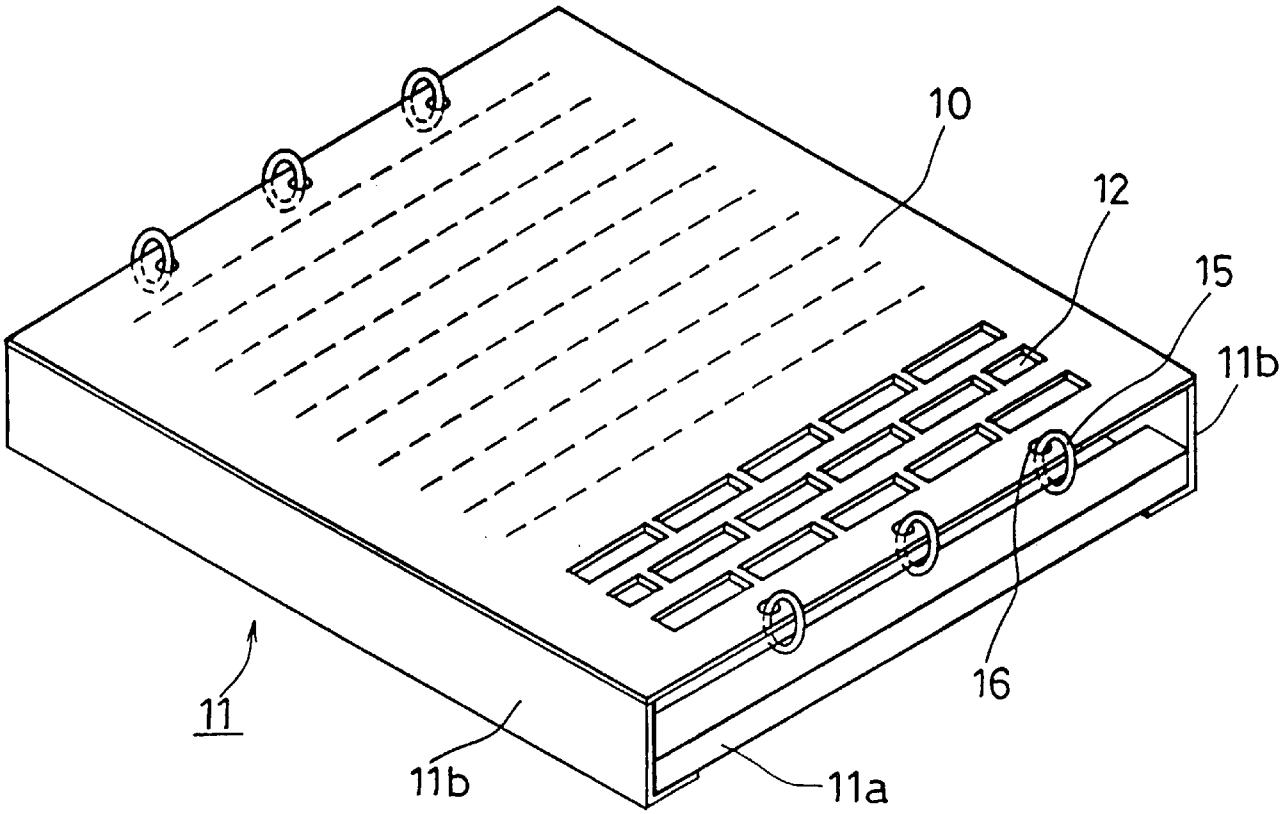
FIG. 11 is a perspective view showing an embodiment of an assembly of a shadow mask and a mask frame according to a fourth embodiment of the present invention.

FIG. 11 shows a perspective view of a shadow mask part according to the fourth embodiment. Vibration attenuators 15 are attached to the right and left end portions of the shadow mask 10, that is, the portions in which apertures 12 for passing electron beams are not formed in the shadow mask 10. The vibration attenuators 15 are ring-shaped, and are inserted through holes 16 formed in the shadow mask 10. Also, the diameter of the holes 16 is somewhat larger than the diameter of the vibration attenuators 15. Therefore, the vibration attenuators 15 are not adhered to the shadow mask 10 at any portion, and are movable while in the condition of being attached to the shadow mask 10.

Therefore, when the shadow mask 10 vibrates, the vibration attenuators 15 hardly move integrally with the shadow mask 10, but vibrate independently from the shadow mask 10. That is, the vibration attenuators 15 vibrate while repeating contacting and sliding with the shadow mask 10 or temporarily being separated therefrom while rotating. The vibration energy of the shadow mask 10 is consumed by friction due to the contact and sliding between the shadow mask 10 and the vibration attenuators 15.

Accordingly, vibration energy is absorbed by the vibration attenuator 15 itself as in the third embodiment. Thus, it is not particularly necessary to connect a second vibration attenuator to the vibration attenuator 15, and vibration of the shadow mask 10 can be attenuated with a simple structure.

Furthermore, the attenuating effect of the vibration attenuator 15 can be adjusted easily by varying the mass of the vibration attenuator 15. Specifically, it is preferable that the mass of the vibration attenuator is in the range of 0.02 to 5.0 g. This range is preferable because of the following reasons: If the mass of the vibration attenuator is less than 0.02 g, a frictional force necessary for the attenuation is hard to ensure. On the other hand, if the mass is more than 5.0 g, vibration of the attachment portion may be restrained from the beginning. In this case, the end portions become nodes of vibration, and the vibration is transferred to the center portion of the shadow mask 10, thus making the vibration even larger.

Moreover, although an example in which the vibration attenuator is attached to the end portions of the shadow mask 10, that is, the portions in which apertures for passing electron beams are not formed, has been described in this embodiment, the vibration attenuator also may be attached to a portion in which apertures for passing electron beams are formed. In this case, it is necessary that the vibration attenuator is attached at any place in that portion other than the apertures for passing electron beams in the shadow mask, so that the display image of the color cathode-ray tube may not be affected. Thus, the size of the vibration attenuator becomes limited, and the processing of the attachment also becomes difficult. However, this can be applied not only in a shadow mask using one-dimensional tension, but also in a shadow mask using two-dimensional tension in which the side surfaces of the shadow mask are fixed by welding, and in which the vibration attenuator of the above third embodiment is difficult to use.

Moreover, in the case of an aperture grill type in which each of the thin elements are not directly connected with each other, by providing the vibration attenuator of this embodiment to all the thin elements or to every certain number of them, vibration of the entire surface of the shadow mask can be decreased effectively. In this case, particularly, there is a benefit in that vibration of the thin elements at the center portion of the shadow mask can be avoided effectively.

Fifth Embodiment

Figure 12:
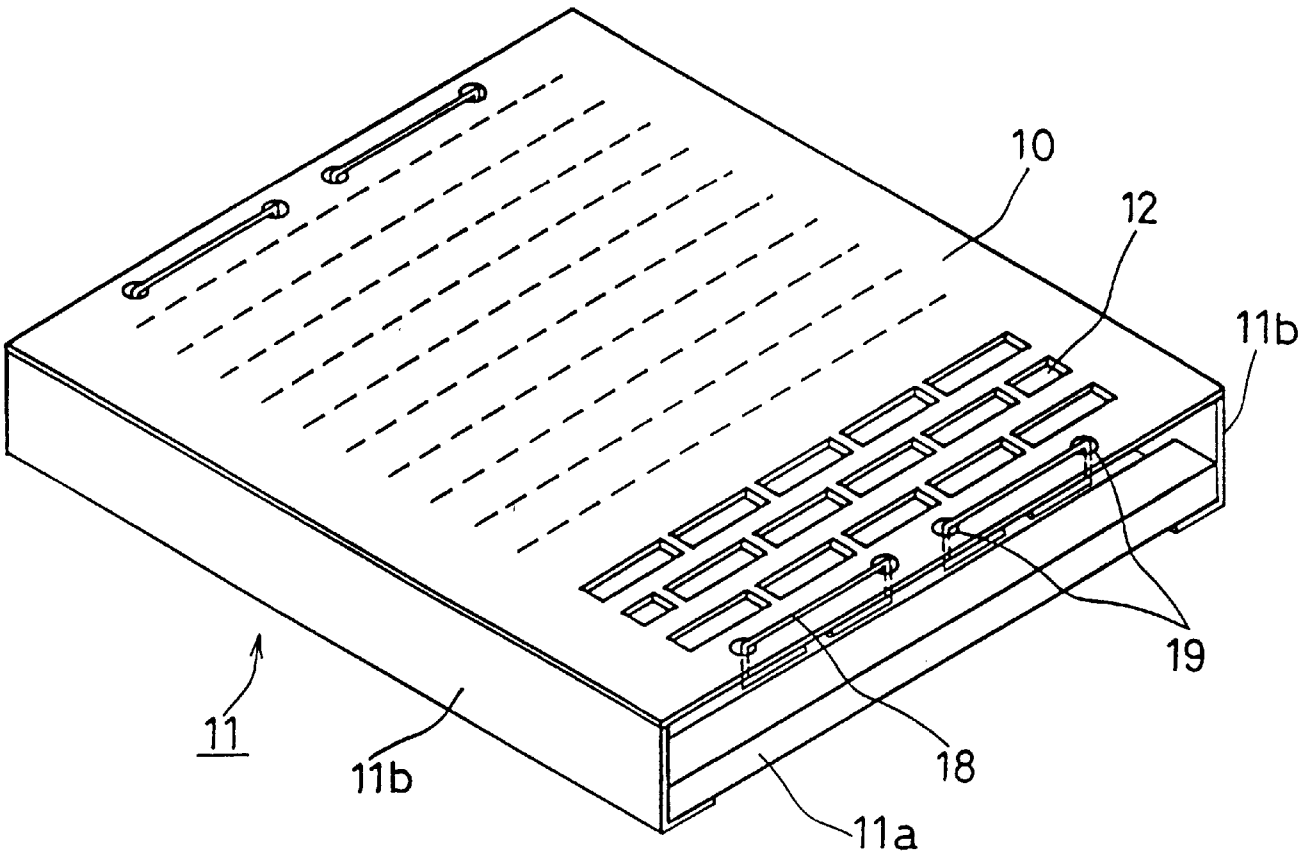
FIG. 12 is a perspective view showing an embodiment of an assembly of a shadow mask and a mask frame according to a fifth embodiment of the present invention.

FIG. 12 shows a perspective view of the shadow mask part according to the fifth embodiment. In this embodiment, although the basic method of attaching a vibration attenuator to a shadow mask 10 is the same as in the fourth embodiment, the shape of the vibration attenuator is different from that of the fourth embodiment.

In this embodiment, vibration attenuators 18 are frame-shaped, and each of the vibration attenuators 18 are inserted through two holes 19 formed in the shadow mask 10. In this embodiment, the same attenuating effect as in the fourth embodiment can be obtained. That is, when the shadow mask 10 vibrates, the vibration attenuators 18 vibrate while repeating contacting and sliding with the shadow mask 10 or temporarily being separated therefrom. The vibration energy of the shadow mask 10 is consumed by friction due to the contacting and sliding between the shadow mask 10 and the vibration attenuators 18.

The attenuating effect by the vibration attenuators 18 can be adjusted easily by varying the mass of the vibration attenuators 18. Furthermore, a dead weight may be attached to the vibration attenuators 18, for example, at their the top ends, to increase their masses. Preferable the range of the mass of the vibration attenuators and the reasons thereof are the same as in the fourth embodiment.

Furthermore, it is also the same as in the fourth embodiment that the vibration attenuator of this embodiment may be used in a shadow mask with a two-dimensional tension or in a shadow mask of aperture grill type.

Moreover, the frame-shaped vibration attenuator is not limited to the shape with an open portion as illustrated in FIG. 12, and it also may have a closed shape. Furthermore, it may be plate-shaped or rod-shaped.

Furthermore, in the above fourth and fifth embodiments, as long as an attachment in such a way that the vibration attenuator may not drop off is enabled, the hole for passing the vibration attenuator through does not need to have a shape with its inner peripheral being closed completely. That is, the hole does not need to have a shape that surrounds the vibration attenuator completely. For example, the vibration attenuators also may be attached to cutout portions which are formed into the effective surface from both side surfaces of the shadow mask.

Sixth Embodiment

Figure 13:
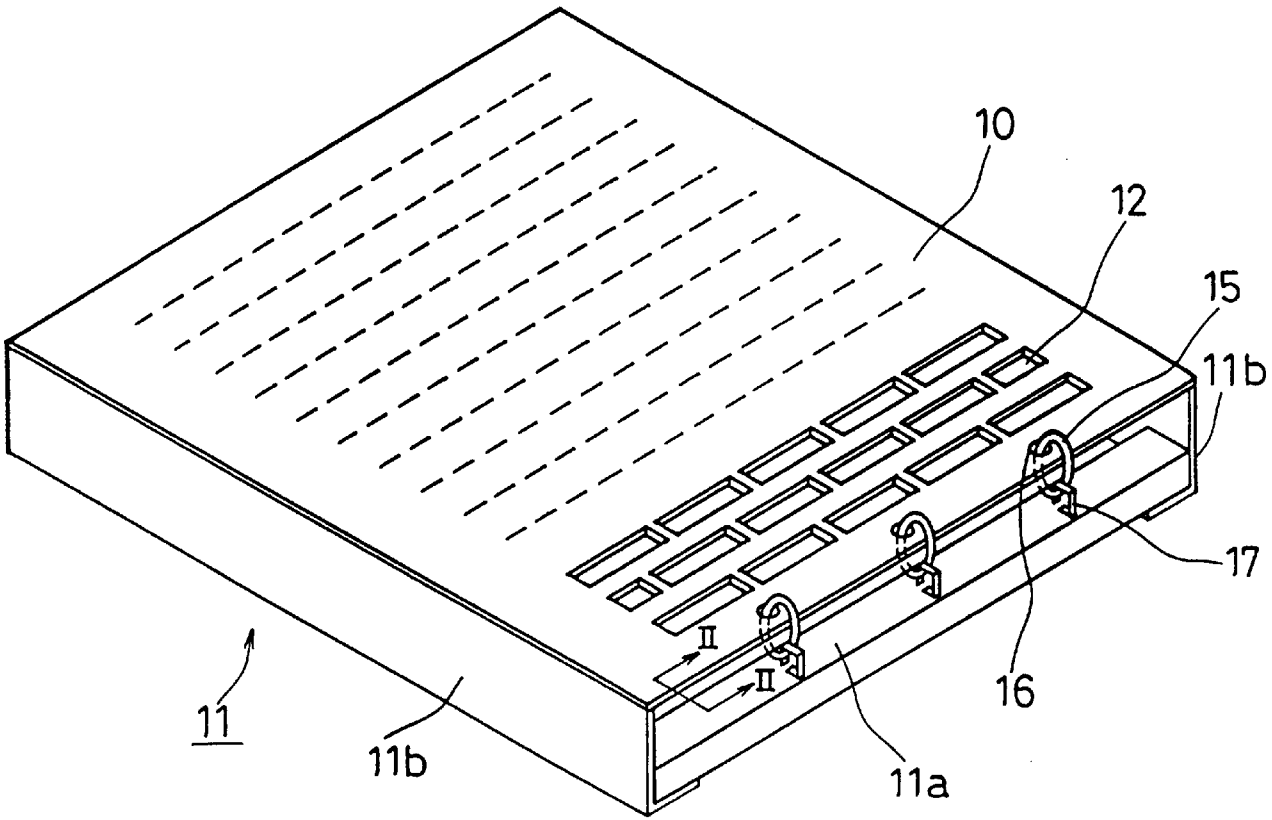
FIG. 13 is a perspective view showing an embodiment of an assembly of a shadow mask and a mask frame according to a sixth embodiment of the present invention.

FIG. 13 shows a perspective view of the shadow mask part according to the sixth embodiment. This embodiment is different from the fourth embodiment in that a second vibration attenuator 17 is attached to the ring-shaped vibration attenuator 15. In the fourth embodiment, because the ring-shaped vibration attenuator 15 has the effect of absorbing vibration energy in itself it was not always necessary to connect it with a second vibration attenuator. This embodiment is applied when it is desired to further improve the effect of attenuating vibration.

Figure 14:
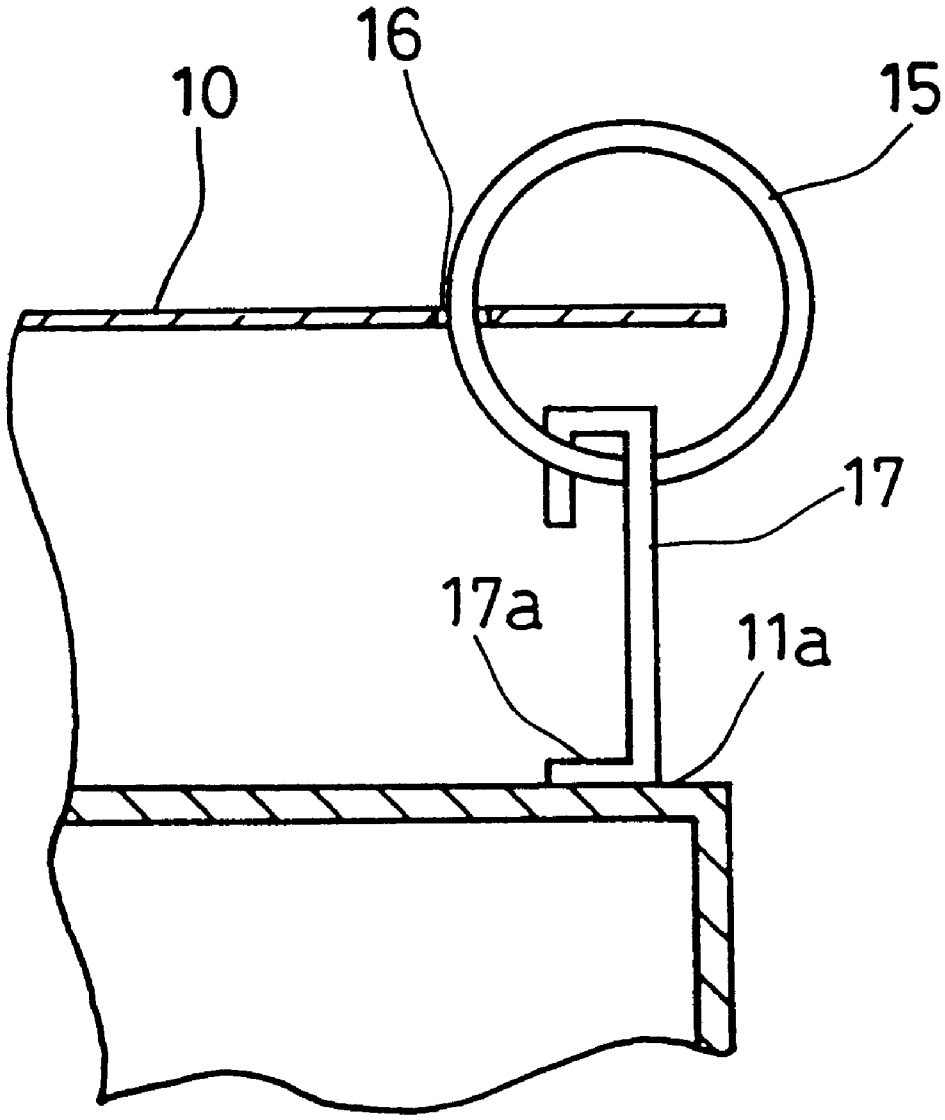
FIG. 14 is a cross-sectional view taken along the line II—II of FIG. 13.

FIG. 14 is a cross-sectional view taken along the line II—II of FIG. 13 to show the relationship between two types of vibration attenuators. The cross section of the hole 16 is also shown by overlapping with the drawing to make the understanding of the attachment structure easier. The attachment structure and the effect of the ring-shaped vibration attenuator 15 are the same as in the fourth embodiment, so that the explanations thereof are omitted.

A hook-shaped attenuator 17 with an angular end is attached to the ring-shaped vibration attenuator 15 in such a way as if hanging to it. One end 17*a* of the vibration attenuator 17 is fixed to the mask frame 11*a* by welding or the like.

As the shadow mask 10 vibrates, the ring-shaped vibration attenuator 15 also vibrates, attenuating the vibration. The attenuated vibration is further attenuated by the vibration attenuator 17. The attenuating effect by the vibration attenuator 17 is the same as in the case between the shadow mask 10 and the ring-shaped vibration attenuator 15. That is, the vibration energy of the ring-shaped vibration attenuator 15 is consumed by the friction due to the contacting and sliding with the vibration attenuator 17.

Although a second vibration attenuator is separately provided in this embodiment, the material of the second vibration attenuator may be the same as that of the ring-shaped vibration attenuator. Moreover, no special processing is required to combine both of the vibration attenuators. Thus, the cost does not increase significantly, and the structure is still simple enough.

Moreover, although a hook-shaped member with an angular end has been described as a second vibration attenuator in this embodiment, as long as it has a shape and location that enable to bring both of the vibration attenuators in contact with each other without being adhered, it may be plate-shaped or rod-shaped, and its end may be L-shaped or semicircular.

Moreover, although an example in which a second vibration attenuator is used together with the ring-shaped vibration attenuator according to the fourth embodiment has been described in this embodiment, the frame-shaped vibration attenuator according to the fifth embodiment also may be used in combination.

Furthermore, in the above fourth through sixth embodiments, by combining them with the shadow mask having a distribution of tension stress as in the above first and second embodiments in the same way as in the third embodiment, the vibration generated at the end portions of the shadow mask can be absorbed. Also, according to their multiplier effects, the amplitude of the shadow mask can be decreased and also its vibration can be absorbed within a short time. Thus, any adverse effects on the display image exerted by vibration of the shadow mask can be canceled almost completely.

Finally, it is understood that the invention may be embodied in other specific forms without departing from the spit or essential characteristics thereof. The embodiments disclosed in this application are to be considered in all respects as illustrative and not restrictive, so that the scope of the invention being indicated by the appended claims rather than by the foregoing description, and all changes which come within the meaning and range of equivalency of the claims are intended to be embraced therein.

What is claimed is:

1. A color cathode-ray tube comprising a frame-shaped mask frame and a shadow mask in which many slot or dot apertures are formed in a flat plate, the shadow mask being stretched and fixed in the mask frame in a condition in which a tension force is applied in one direction, wherein among side faces of the mask frame, each of side faces arranged in a direction perpendicular to the direction in which the tension force is applied is configured so that a portion thereof on the shadow mask side that supports the shadow mask is not separated from a portion thereof on an opposite side to the shadow mask, and a vibration of the shadow mask throughout its surface caused by a vibration propagated to the color cathode ray tube is such that an amplitude in an end portion of the shadow mask in the direction perpendicular to the direction in which the tension force is applied is not less than a certain amount relative to an amplitude in a center portion of the shadow mask, in a vibration mode of a seventh or less order for a resonance of the shadow mask caused by the vibration propagated to the color cathode-ray tube, wherein an amplitude in the end portion of the shadow mask is not less than 20% with respect to an amplitude in the center portion of the shadow mask.

2. The color cathode-ray tube according to claim 1, wherein a tension stress in the center portion of the shadow mask is larger than a tension stress in the end portion of the shadow mask.

3. The color cathode-ray tube according to claim 2, wherein when the tension stress in the center portion of the shadow mask is $\sigma 1$ and the tension stress in the end portion of the shadow mask is $\sigma 2$, an inequality $$\sigma 1 \geqq 1.1\sigma 2$$

is satisfied.

4. The color cathode-ray tube according to claim 1, wherein there is a maximum value of tension stress between the center portion and the end portion of the shadow mask.

5. The color cathode-ray tube according to claim 4, wherein when the tension stress in the center portion of the shadow mask is $\sigma 1$, the tension stress in the end portion of the shadow mask is $\sigma 2$, and the tension stress in an intermediate portion between the center portion and the end portion is $\sigma 3$, inequalities $$\sigma 3 \geqq 1.1\sigma 1,$$

$$\sigma 2 \geqq \sigma 1,$$

and $$\sigma 3 \geqq \sigma 2$$

are satisfied.

* * * * *